US007484250B2

(12) United States Patent
Chiang

(10) Patent No.: US 7,484,250 B2
(45) Date of Patent: Feb. 3, 2009

(54) PROTECTIVE HIP PAD

(76) Inventor: Pang-Ching Chiang, 9F, No. 295, Sec. 4, Chung-Hsiao E. Rd., Taipei (TW)

( * ) Notice: Subject to any disclaimer, the term of this patent is extended or adjusted under 35 U.S.C. 154(b) by 59 days.

(21) Appl. No.: 11/804,010

(22) Filed: May 15, 2007

(65) Prior Publication Data

US 2008/0282456 A1 Nov. 20, 2008

(51) Int. Cl.
*A41D 13/00* (2006.01)

(52) U.S. Cl. ..... 2/465

(58) Field of Classification Search ..... 2/23, 2/465, 467, 92, 267, 227, 238, 22, 24, 16, 2/455, 911, 456, 242; 602/23, 26, 61; 5/630, 5/632, 648, 652; 128/846, 888
See application file for complete search history.

(56) References Cited

U.S. PATENT DOCUMENTS 4,573,216 A * 3/1986 Wortberg ..... 2/465
4,641,641 A * 2/1987 Strock ..... 128/846
5,020,547 A * 6/1991 Strock ..... 128/891
5,717,997 A * 2/1998 Garcia ..... 2/23
6,334,443 B1 * 1/2002 Olsen ..... 128/846
6,745,406 B2 * 6/2004 Ruane ..... 2/465

* cited by examiner

*Primary Examiner*—Tejash Patel
(74) *Attorney, Agent, or Firm*—Jackson Walker, LLP

(57) ABSTRACT

A protective hip pad includes a shield, a shock absorbing assembly and a cushioned connector. The shield is substantially elliptical and has an outer shield surface having an inner surface and a central through hole. The shock absorbing assembly abuts the inner surface of the shield and has a curved plate, a mounting hole and a sealed air cushion. The mounting hole is formed through the curved plate and corresponds to and aligns with the central through hole in the shield. The sealed air cushion is hollow and is formed around the mounting hole in the curved plate. The cushioned connector is mounted in the central through hole in the shield and the mounting hole in the curved palate and has an outer end protruding from the outer-shield surface of the shield.

4 Claims, 4 Drawing Sheets

PROTECTIVE HIP PAD

BACKGROUND OF THE INVENTION

1. Field of Invention

The present invention relates to a protective pad, and more particularly to a protective hip pad that protects a person's hipbone area.

2. Description of the Related Art

Because a person's hipbones protrude bilaterally, a person's hipbones are particularly susceptible to being bumped. A first generation hipbone protective hip pad was developed for people who need hipbone protection, such as pregnant women. The first generation protective hip pad has a curved polyethylene (PE) plate and a bag. The bag holds the PE plate. However, the PE plate is too hard to provide enough protection.

Hence, a second-generation protective hip pad has been developed and has a curved PE plate and a foam member. The foam member is mounted inside the PE plate and presses against the person's body. However, the foam member compresses against the person's body and will not absorb shock well.

To overcome the shortcomings, the present invention provides a hipbone protective hip pad to mitigate or obviate the aforementioned problems.

SUMMARY OF THE INVENTION

The primary objective of the present invention is to provide a protective hip pad that resists compression against a person's body and provides an additional shock-absorbing effect.

A protective hip pad in accordance with the present invention comprises a shield, a shock absorbing assembly and a cushioned connector. The shield is curved, substantially elliptical and has an outer shield surface, an inner surface and a central through hole. The shock absorbing assembly abuts the inner surface of the shield and has a curved plate, a mounting hole and a sealed air cushion. The mounting hole is formed through the curved plate and corresponds to and aligns with the central through hole in the shield. The sealed air cushion is hollow and is formed around the mounting hole in the curved plate. The cushioned connector is mounted in the central through hole in the shield and the mounting hole in the curved plate and has an outer end protruding from the outer shield surface of the shield.

Other objectives, advantages and novel features of the invention will become more apparent from the following detailed description when taken in conjunction with the accompanying drawings.

DETAILED DESCRIPTION OF THE INVENTION

Figure 1:
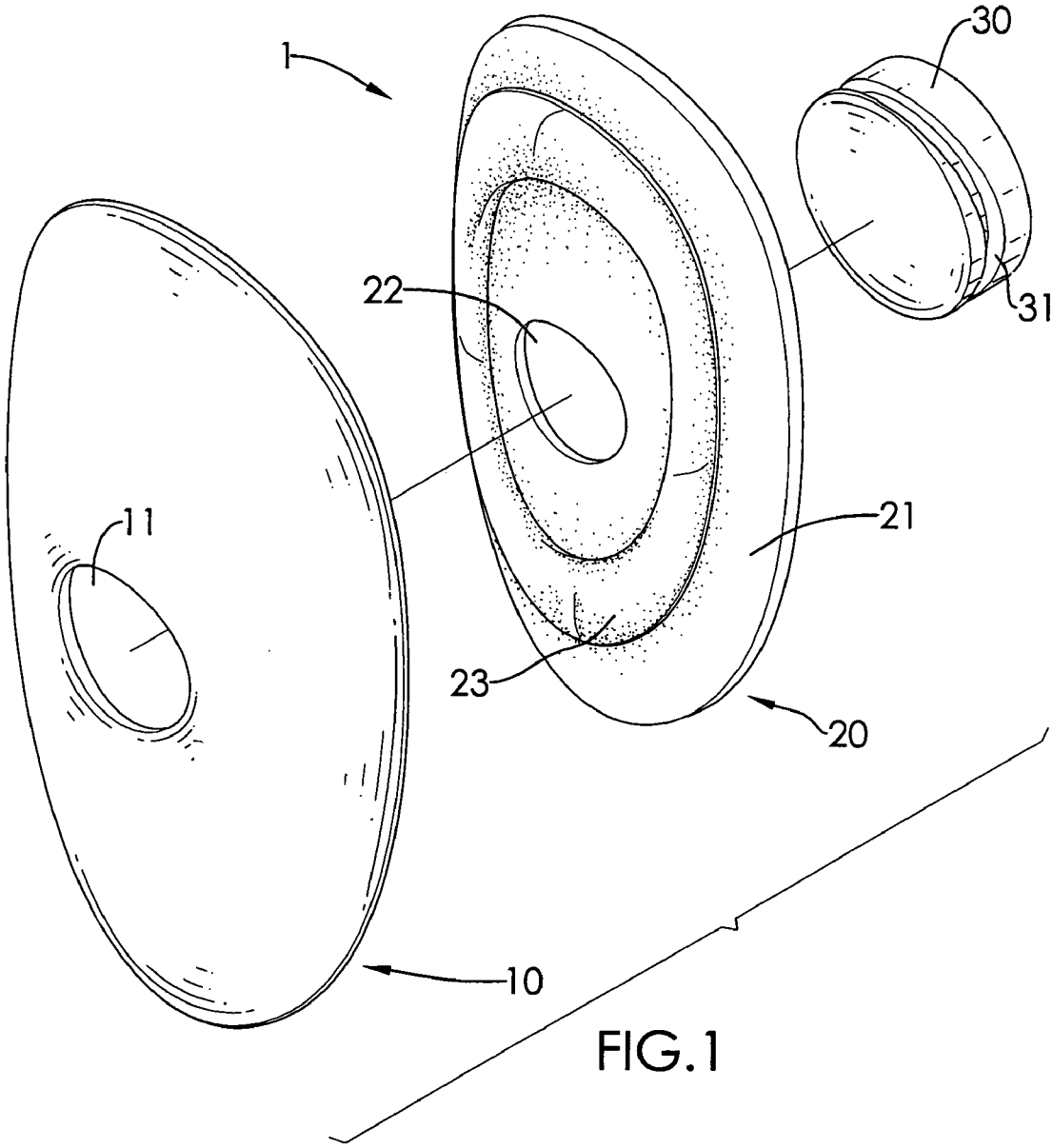
FIG. 1 is an exploded perspective view of a protective hip pad in accordance with the present invention.
Figure 3:
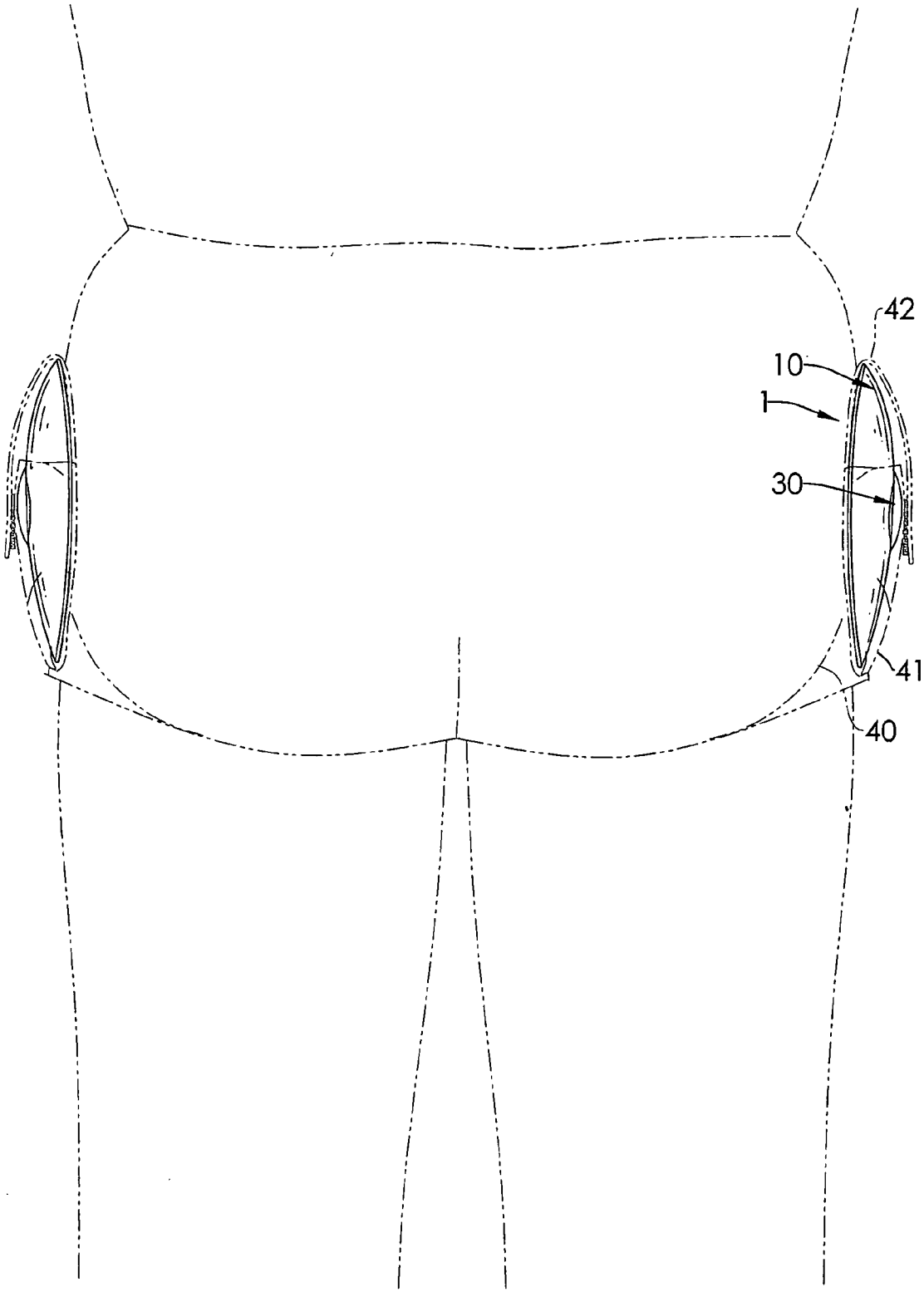
FIG. 3 is an operational side view of the protective hip pads in FIG. 1 in a pair of pants.
Figure 4:
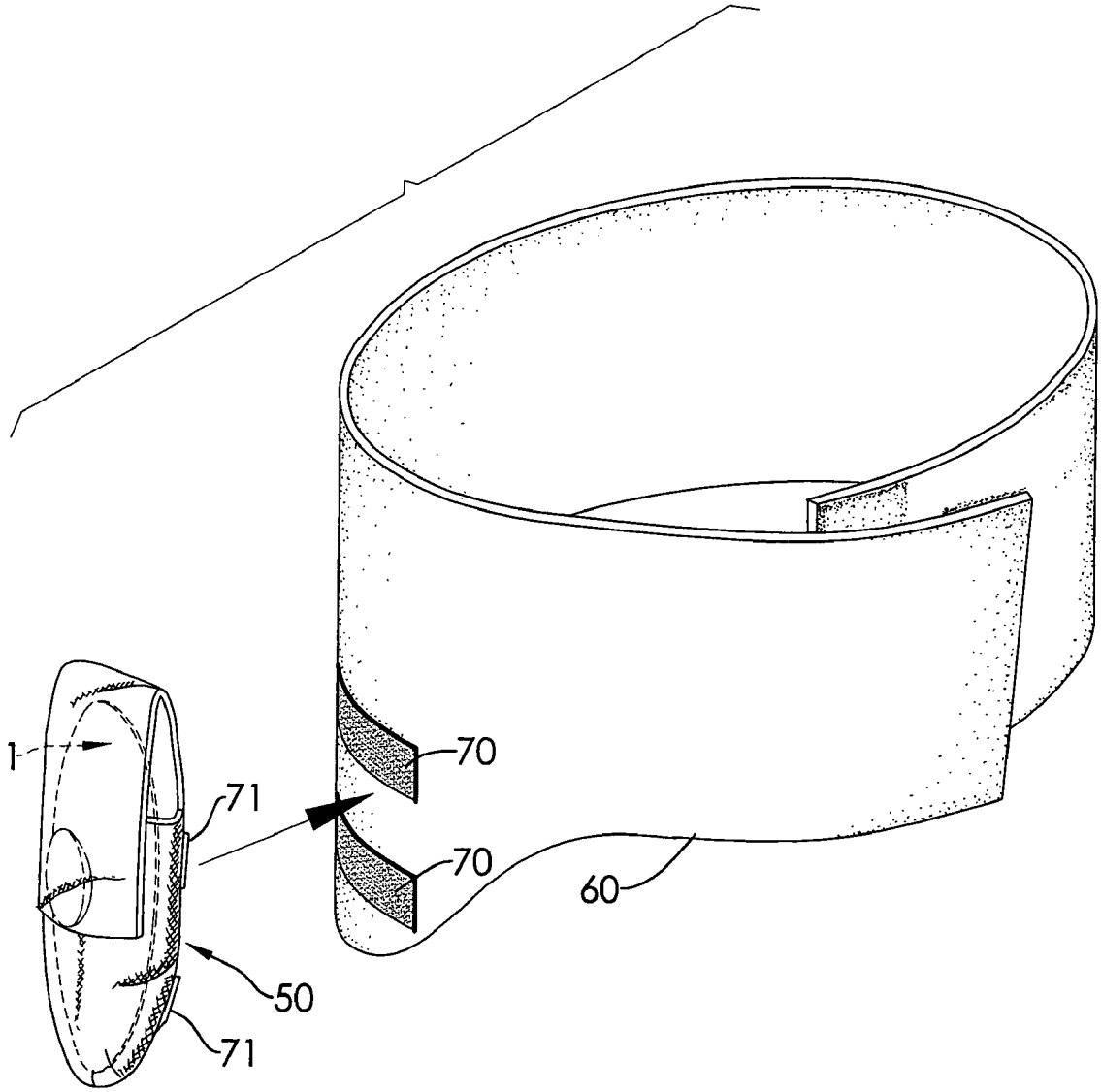
FIG. 4 is an operational exploded perspective view of the protective hip pad in FIG. 1 and a support belt.

With reference to FIGS. 1, 3 and 4, a protective hip pad (1) in accordance with the present invention comprises a shield (10), a shock absorbing assembly (20) and a cushioned connector (30) and may be used with a specially fitted pair of pants (40) or a bag (50) and support belt (60).

The shield (10) may be made of polyethylene (PE), is curved and substantially elliptical and has an outer shield surface, an inner surface and a central through hole (11).

Figure 2:
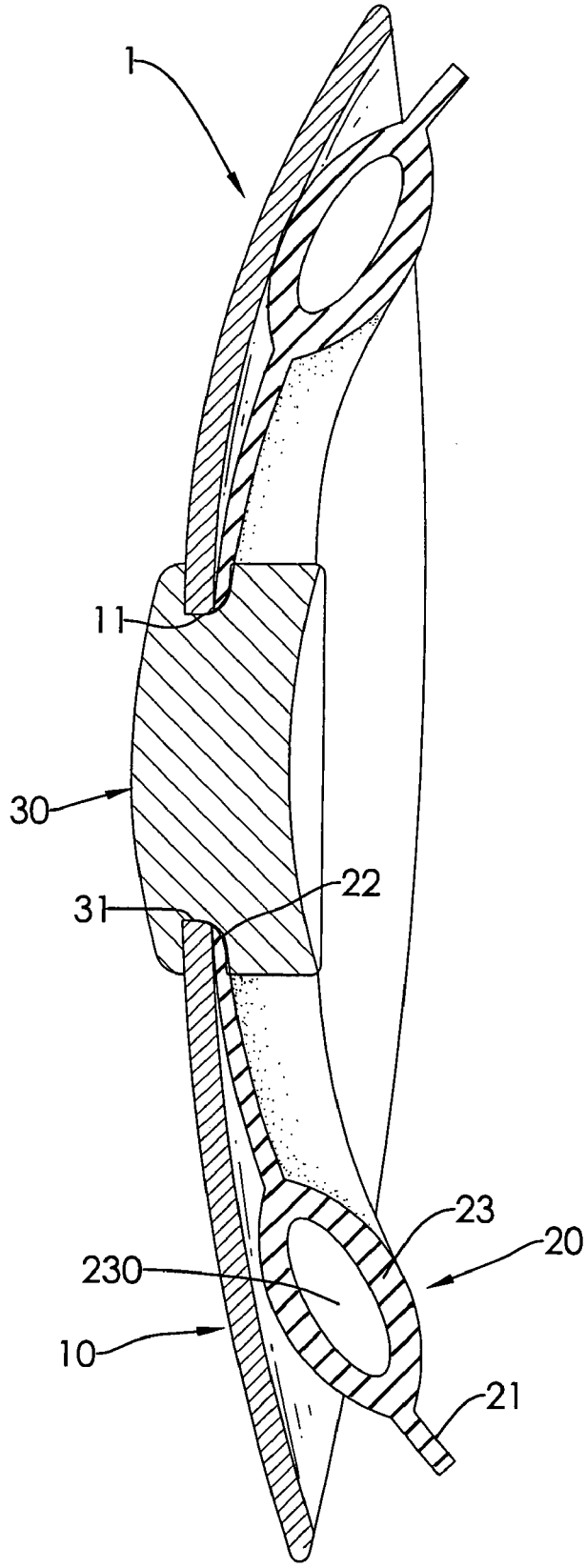
FIG. 2 is a cross-sectional side view of the protective hip pad in FIG. 1.

The shock absorbing assembly (20) is resilient material such as rubber, abuts the inner surface of the shield (10) and has a curved plate (21), a mounting hole (22) and a sealed air cushion (23). The mounting hole (22) is formed through the curved plate (21) and corresponds to and aligns with the central through hole (11) in the shield (10). With further reference to FIG. 2, the sealed air cushion (23) is hollow, is formed around the mounting hole (22) in the curved plate (21) and has a air channel (230) defined in the sealed air cushion (23) and holding a gas such as air. So the sealed air cushion (23) can compress to absorb shock. In addition, the sealed air cushion (23) of the protective hip pad (1) comfortably presses against a person's hipbone area without being completely compressed.

The cushioned connector (30) is resilient, may be a cylinder, connects the shield (10) to the shock absorbing assembly (20), is mounted in the central through hole (11) in the shield (10) and the mounting hole (22) in the curved plate (21) and has an outer cushioned connector surface, an optional annular groove (31), an outer end and an inner end. The annular groove (31) is formed in the outer cushioned connector surface of the cushioned connector (30) near the outer end and engages the central through hole (11) in the shield (10) and the mounting hole (22) in the curved plate (21). The outer end of the cushioned connector (30) may be curved and protrudes from the outer shield surface of the shield (10).

With reference to FIG. 3, when the protective hip pad (1) is in use, a specially fitted pair of pants (40) is prepared for the user and has two sides, two pockets (41) and two covers (42). The pockets (41) are mounted respectively on the sides of the pair of pants (40) and each pocket (41) has an upward opening. The covers (42) are formed respectively upon the openings of the pockets (41) to cover the openings. Two protective hip pads (1) are placed respectively in the pockets (41). When the user wears the pant (40), the cushion members (30) of the protective hip pads (1) are aligned with the hipbone area of the user. Therefore, if external objects bump the hipbone area of the user and one of the protective hip pad (1), the cushioned connector (30) can absorb shock and protect the user's hipbone. In addition, if a large region of the hipbone area is bumped and the shield (10) is pressed, the shield (10) can deform and press the sealed air cushion (23). So the force applied on the hipbone area of the user can be absorbed by the sealed air cushion (23).

With reference to FIG. 4, the protective hip pad (1) can be used with a bag (50) and a support belt (60). The bag (50) accommodates the protective hip pad (1) and is connected to the support belt (60) with a hook and loop closure (70, 71), a button fastener or a hook fastener. When the user wear the support belt (60), the protective hip pad (1) is aligned with the hipbone area of the user and provide the capacity of the integrated hipbone protection.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A protective hip pad comprising:

a shield being curved and substantially elliptical and having an outer shield surface;

an inner surface; and a central through hole;

a shock absorbing assembly being resilient material, abutting the inner surface of the shield and having a curved plate;

a mounting hole being formed through the curved plate and corresponding to and aligning with the central through hole in the shield; and a sealed air cushion being hollow and being formed around the mounting hole in the curved plate to hold gas and to be compressed for absorbing shock; and a cushioned connector being resilient, connecting the shield to the shock absorbing assembly, being mounted in the central through hole in the shield and the mounting hole in the curved plate and having an outer cushioned connector surface;

an outer end protruding from the outer shield surface of the shield and an inner end.

2. The protective hip pad as claimed in claim 1, wherein the cushioned connector is a cylinder and further has an annular groove formed in the outer cushioned connector surface of the cushioned connector near the outer end and engaging the central through hole in the shield and the mounting hole in the curved plate.

3. The protective hip pad as claimed in claim 1, wherein the shield is made of polyethylene (PE).

4. The protective hip pad as claimed in claim 2, wherein the outer end of the cushioned connector is curved.

* * * * *